US006564685B1

(12) United States Patent
Beaton

(10) Patent No.: US 6,564,685 B1
(45) Date of Patent: May 20, 2003

(54) COMBINATION CUTTING BOARD AND LEVERAGED KNIFE

(76) Inventor: Rex L. Beaton, 64 Sanford Dr., Newark, DE (US) 19713

( * ) Notice: Subject to any disclaimer, the term of this patent is extended or adjusted under 35 U.S.C. 154(b) by 173 days.

(21) Appl. No.: 09/711,396

(22) Filed: Nov. 14, 2000

(51) Int. Cl.[7] ..... B26B 1/04

(52) U.S. Cl. ..... 83/609; 30/123; 269/289 R

(58) Field of Search ..... 83/609, 605, 606, 83/699.51, 574, 527, 607, 608, 634, 698.11, 698.71; 30/123; 403/292, 335, 336; 269/13, 15, 16, 302.1, 289 R, 290, 909, 293

(56) References Cited

U.S. PATENT DOCUMENTS

| | | | | | |
|---|---|---|---|---|---|
| 6,012 | A | * | 1/1849 | Taft | 118/208 |
| 911,900 | A | * | 2/1909 | Newman | 83/608 |
| 1,268,484 | A | * | 6/1918 | Olasz | 30/120.4 |
| 1,746,744 | A | * | 2/1930 | Siegle | 83/34 |
| 2,822,845 | A | * | 2/1958 | Medlin | 100/103 |
| 3,457,818 | A | * | 12/1970 | McManus | 83/599 |
| 3,780,436 | A | * | 12/1973 | Pellman | 30/123 |
| 4,094,221 | A | | 6/1978 | Jacoby | |
| 4,811,642 | A | * | 3/1989 | Sorbie | 83/574 |
| 6,148,704 | A | * | 11/2000 | Lewis | 83/167 |

* cited by examiner

*Primary Examiner*—Allan N. Shoap
*Assistant Examiner*—Stephen Choi
(74) *Attorney, Agent, or Firm*—E. Alan Uebler, PA

(57) ABSTRACT

A cutting board and leveraged knife apparatus is provided which facilitates cutting of a variety of objects, from large items such as turnips to the rapid, repetitive chopping of smaller items such as carrots or celery. The apparatus includes a cutting board having a vertically oriented support member extending therefrom, the support member having a plurality of fulcrums positioned at convenient, discrete vertical intervals proceeding upwardly from the cutting board. The apparatus includes a knife, preferably one of the variety known as a "chef's knife", having in its blade thereof, in the upper edge proximate its tip, means for removably engaging a convenient one of the fulcrums. When an item to be cut is placed on the cutting board adjacent the support member, and the knife engages with a convenient fulcrum, cutting of the item is enhanced and facilitated through the lever action of the knife and fulcrum.

11 Claims, 2 Drawing Sheets

COMBINATION CUTTING BOARD AND LEVERAGED KNIFE

BACKGROUND OF THE INVENTION

Cutting boards for use in cutting various types of foodstuffs are well known, as are several types of knives to be used in combination with such boards. A preferred type of knife for such use is one with a sturdy blade and characteristically referred to as a "Chef's Knife".

Variations on the theme of the combination of cutting board and knife are also known, as are levered apparatus useful in cutting different types of food. The following patents disclose different forms of levered cutting devices:

U.S. Pat. No. 5,873,294 (pizza)

U.S. Pat. No. 5,245,902 (vegetables)

U.S. Pat. No. 4,137,807 (fruits and vegetables)

These devices all have in common that their cutting mechanisms are attached to their respective workpiece holders and pivot about an attached, fixed pivot point.

U.S. Pat. No. 4,094,221, issued Jun. 13, 1978, discloses a cutting board attachment for use with an ordinary kitchen knife. The attachment comprises a support member in the shape of an L-shaped plate, with one leg of the "L" being disposed vertically of a cutting board and the other leg of the "L" attached to the cutting block. In the vertical leg of the plate are vertical slots, depicted at different elevations, and other similar openings in the plate, the upper edges of which act as fulcrums for receiving the tip of the blade of the kitchen knife so that the cutting blade can be used as a lever, pivotable downwardly. The attachment of the '221 patent is said to facilitate the ease with which a conventional knife may be use for cutting frozen foods and the like ('221, Abstract).

SUMMARY OF THE INVENTION

Apparatus is provided for cutting items, especially foodstuffs. The apparatus includes a cutting board having an opening therein which passes through the cutting board and is located in adjacent proximity to one edge of the cutting board. Through this opening is inserted a fulcrum supporting member having a vertically oriented, fulcrum-housing stem and a flanged base. The stem is removably inserted through the opening in the cutting board and extends vertically through and upwardly therefrom, and is removably secured thereat to the cutting board by the flanged base. The vertical stem member houses a plurality of fulcrums therein positioned at spaced apart intervals proceeding vertically upwardly from the cutting board. The apparatus further includes a knife having a blade and a handle, which blade has, proximate its tip or point end, means for removably engaging one of the fulcrums.

When an item to be cut is placed on the cutting board adjacent the vertical stem, and the knife blade engages a convenient one of the fulcrums, cutting of the item is enhanced and facilitated through the lever action of the knife blade and its engaged fulcrum.

The fulcrums preferably are horizontally oriented pins for engaging the knife blade, positioned at discrete vertical intervals proceeding upwardly from the cutting board, and three fulcrums is most preferred. The means for engaging the fulcrums may be a notch formed in the upper edge of the knife blade proximate the tip of the blade. The board may be made from wood or plastic or other suitable material and the supporting member is made from metal, e.g., aluminum or, most preferably, stainless steel.

All components of the apparatus are preferably dishwasher safe through many repeated cycles of automatic dishwashing.

DETAILED DESCRIPTION OF THE INVENTION AND

PREFERRED EMBODIMENTS WITH REFERENCE TO THE ACCOMPANYING DRAWINGS

A cutting board and leveraged knife apparatus is provided which facilitates cutting of a variety of objects, from large items such as turnips to the rapid, repetitive chopping of smaller items such as carrots or celery. The apparatus includes a cutting board having a vertically oriented support member extending therefrom, the support member having a plurality of fulcrums positioned at convenient, discrete vertical intervals proceeding upwardly from the cutting board. The apparatus includes a knife, preferably one of the variety known as a "chef's knife", having in its blade thereof, in the upper edge proximate its tip, means for removably engaging a convenient one of the fulcrums. When an item to be cut is placed on the cutting board adjacent the support member, and the knife engages with a convenient fulcrum, cutting of the item is enhanced and facilitated through the lever action of the knife and fulcrum.

The apparatus of the invention is especially suited for cutting hard vegetables and fruits such as turnips, potatoes, carrots and other tubers, and roots, melons, block cheeses, frozen foods, meats, poultry and fish, all in a safe and efficient operation and with relative ease involving minimum endeavor and energy.

An added feature of the invention resides in the fact that the apparatus may be disassembled and all component parts may be placed in the dishwasher for ease of cleaning.

Figure 1:
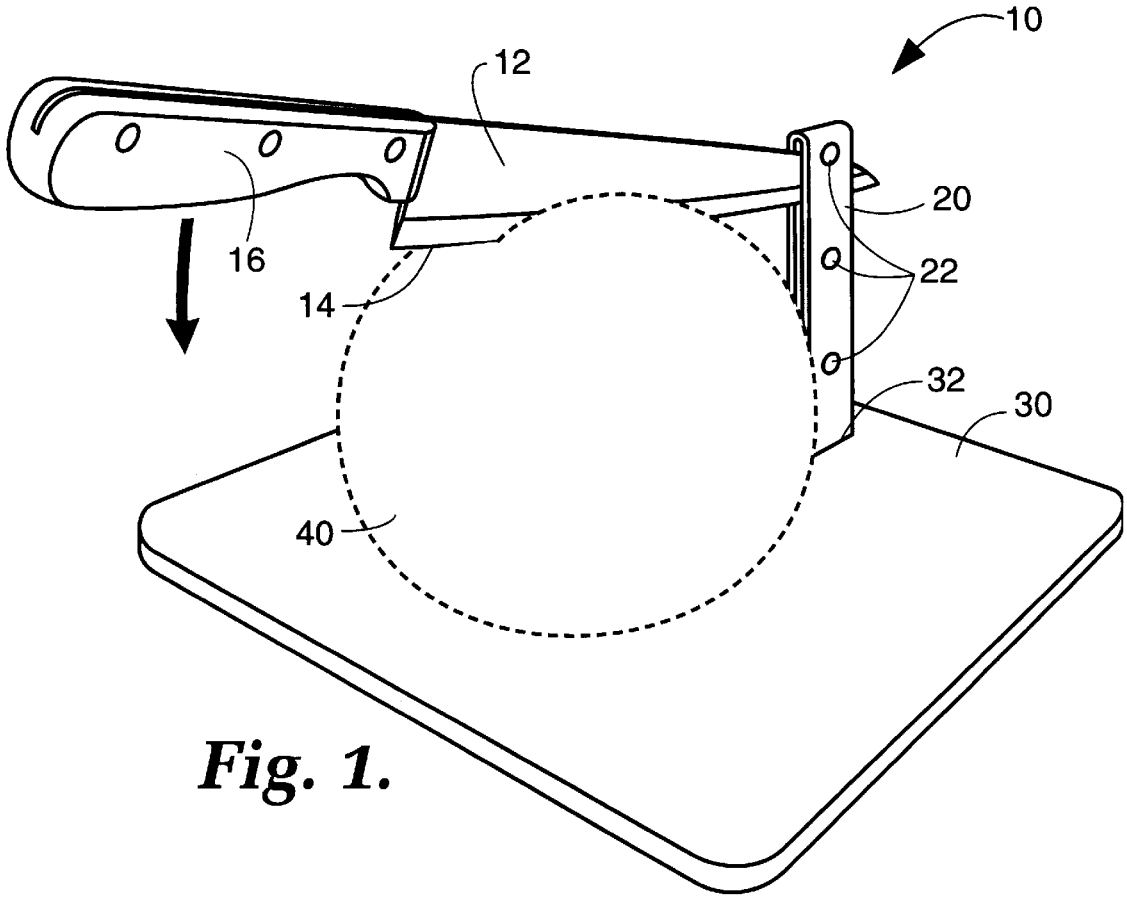
FIG. 1 is an overall perspective view of the apparatus according to the invention in use cutting an item (in phantom) of a fruit or vegetable.

A detailed description of the invention and preferred embodiments is best provided with reference to the drawings wherein FIG. 1, in an overall perspective view, depicts the invention 10, including a cutting knife having a blade 12 with cutting edge 14, and handle 16. The tip or point end of the knife blade 12 is inserted into the slot of the vertical fulcrum support 20, as shown. Support 20 extends vertically upwardly from the cutting board 30 through an opening 32 in board 30, to be described in more detail below. The item to be cut, 40, depicted in phantom, is placed adjacent the fulcrum support 20, upon the board 30, and the knife blade 12 is inserted into the support housing 20 wherein the blade 12 engages a convenient one of the fulcrum pins 22, to be described more fully below. In FIG. 1, the number of fulcrum pins is shown to be three, but it will be clear that more or less could be employed. Three are preferred. The cutting board is preferably made of wood or plastics, but other materials suitable for use as cutting boards may be employed.

Figure 2:
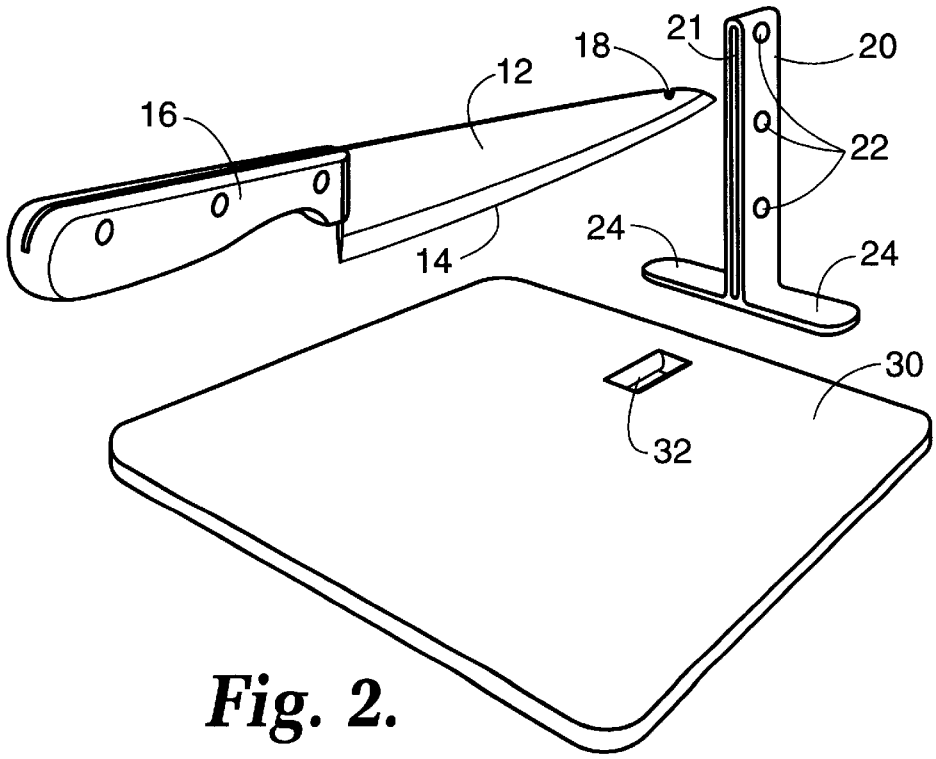
FIG. 2 is a perspective view of the components of the invention in a disassembled orientation and depicting each of the components separately.

FIG. 2 shows a perspective view of the components of the invention 10 separated in space for illustration and ease of visualization. Therein, a typical "chef's knife", having handle 16 and blade 12, which blade is typically 9–12 inches in length, is shown having notch or groove 18 fashioned in its upper edge in relative proximity to the blade tip. Upon insertion of the blade tip into the slot 21 of housing 20, this notch 18 may be caused to engage a convenient one of the pins 22, which pins act as fulcrums, and allow the knife blade 12 to be levered downwardly, as indicated by the arrow shown in FIG. 1, as the item 40 is cut.

The vertical support member 20, depicted in FIG. 2 as separated from the cutting board 30, is in fact caused to be inserted from below the board 30 upwardly through the opening 32, to the extent that it is stopped by its flanged "feet" 24, as shown, arriving at its operative configuration shown in FIG. 1.

Figure 3:
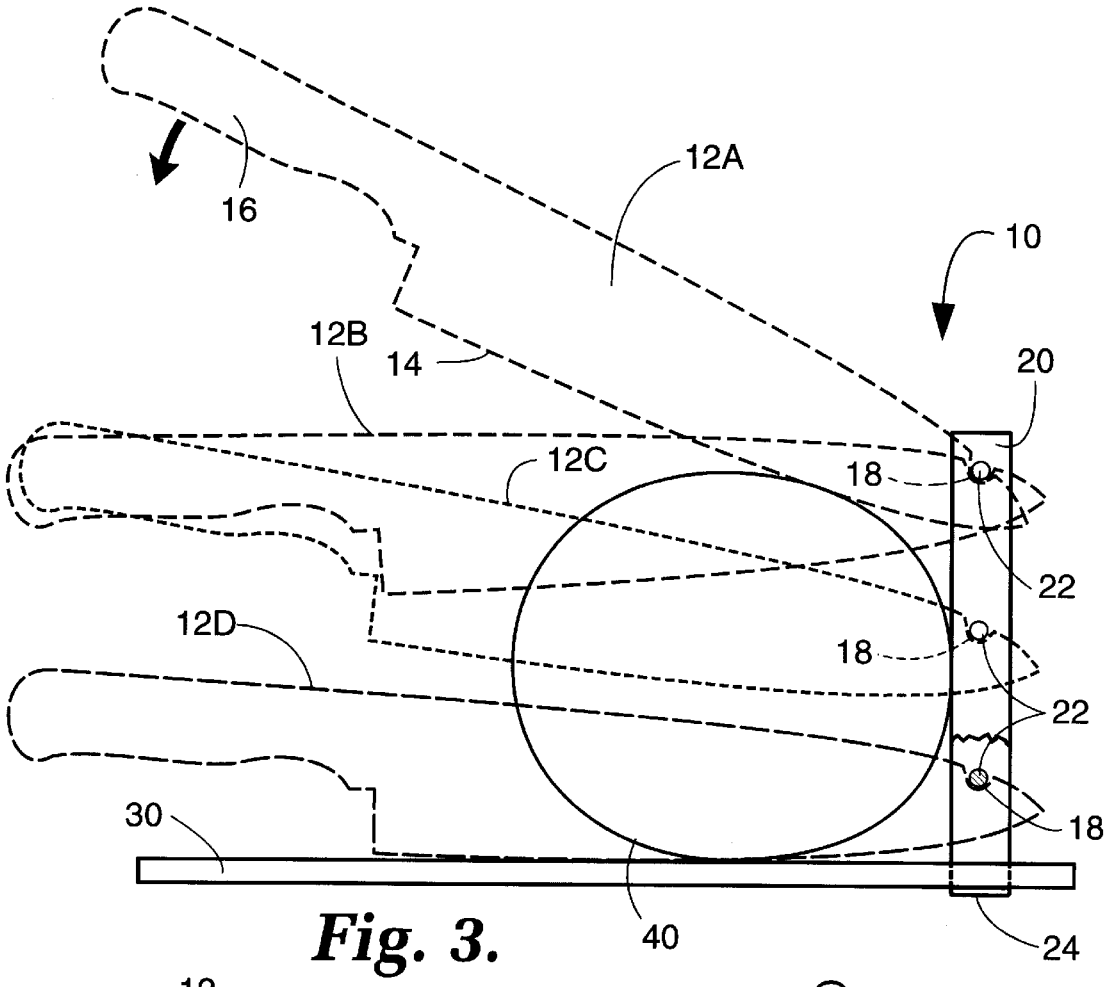
FIG. 3 depicts several possible positions of the knife of the apparatus as it may be employed in cutting through an item, all according to the invention.

In FIG. 3, various stages of a cutting operation are depicted. In the uppermost of the diagrams of the knife shown, the knife blade 12A is shown engaged by means of notch 18 with the uppermost fulcrum pin 22, as an initial cut of a large workpiece, e.g., a turnip 40, is begun. As the knife blade 12A is forced downwardly, indicated by the arrow, this initial cut is completed at the position indicated by 12B. The knife is retracted and notch 18 is caused to engage the middle pin 22, depicted as 12C in FIG. 3, and the cutting is continued. At this position, cuts of smaller items such as potatoes, parsnips or apples may be accomplished. Next, as depicted by knife position 12D, the notch 18 in blade 12 may be caused to engage the lowermost pin 22 to complete the cut of the workpiece 40.

Figure 4:
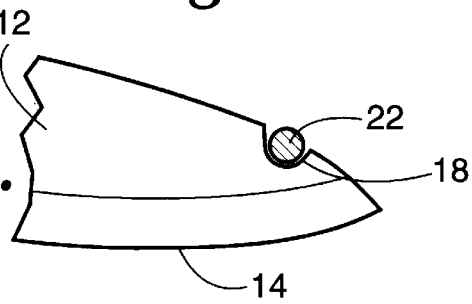
FIG. 4 depicts one form of notch in the upper edge and near the tip of the cutting knife, which notch is useful for releasably engaging the pivot pin which acts as a fulcrum about which the knife pivots during cutting.
Figure 5:
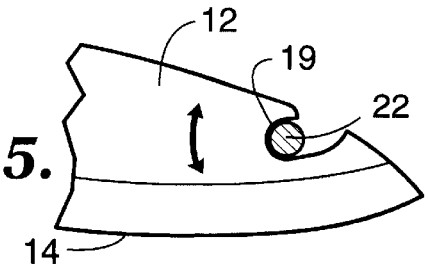
FIG. 5 depicts an alternate form of notch or slot which enables the knife to engage and pivot about the pin and which is especially useful for rapid cutting, i.e., chopping, operations.

FIG. 4 depicts an exploded view of a tip end of knife blade 12 showing a notch 18 suitable for engaging a fulcrum pin 22. An alternative notch configuration 19 is shown in FIG. 5, wherein a part of the notch opening is designed to overhang the engaged pin 22 as shown, to provide greater stability for the knife blade 12 during rapid up and down motions, as indicated by the double-headed arrow shown, as would be encountered in rapid chopping or dicing, for example, of carrots or celery or the like.

Figure 6:
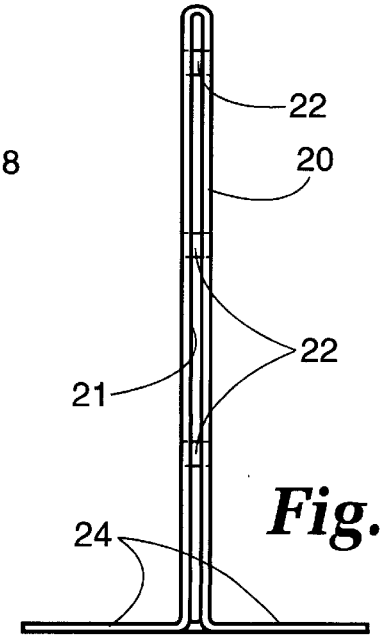
FIG. 6 is a front elevation of one embodiment of the vertically oriented fulcrum support of the apparatus of the invention.

For completeness, FIG. 6 shows a front elevation of one embodiment of the fulcrum support member 20, including the flanged "feet" 24, and its integral fulcrum pins 22 extending horizontally through the center slot 21.

All parts are made of suitable materials as described herein, and all materials are preferably those which can withstand repeated cycles of automatic dishwashing without adverse effects. Stainless steel for the support 30 and the fulcrum pins 22 is preferred.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for cutting foodstuffs, comprising:

(a) a cutting board having an opening therein, said opening passing through the cutting board and extending through a top surface thereof to and through a parallel bottom surface thereof, located in adjacent proximity to one edge of said cutting board;

(b) a fulcrum supporting member having a vertically oriented, fulcrum-housing stem and a flanged base, said stem being removably inserted through said opening in said cutting board and extending vertically through and upwardly of said top surface therefrom, and being removably secured thereat to said cutting board by said flanged base abutting said bottom surface, (c) said fulcrum-housing stem housing a plurality of fulcrums therein positioned at spaced apart intervals proceeding vertically upwardly from said cutting board, and including (d) a knife having a blade and a handle, said blade having, proximate its tip or point end, means for removably engaging one of said fulcrums, whereby, when an item to be cut is placed on said cutting board adjacent said vertical stem, and said knife blade engages a convenient one of said fulcrums, cutting of said item is enhanced and facilitated through the lever action of said knife blade and its engaged fulcrum.

2. The cutting apparatus of claim 1 wherein said fulcrums comprise horizontally oriented pins for engaging said knife blade, positioned at discrete vertical intervals proceeding upwardly from said cutting board.

3. The apparatus of claim 1 having three fulcrums.

4. The apparatus of claim 1 wherein the means for engaging said fulcrums is a notch formed in the upper edge of said knife blade proximate the tip of said blade.

5. The apparatus of claim 1 wherein said board is made from wood.

6. The apparatus of claim 1 wherein said board is made from plastic.

7. The apparatus of claim 1 wherein said supporting member is made from metal.

8. The apparatus of claim 1 wherein said supporting member is made of aluminum.

9. The apparatus of claim 1 wherein said supporting member is made of stainless steel.

10. The apparatus of claim 1 wherein said fulcrums are made from stainless steel.

11. The apparatus of claim 1 wherein all components thereof are dishwasher safe.

* * * * *